US006099073A

United States Patent [19]

Bruschi

[11] Patent Number: 6,099,073

[45] Date of Patent: Aug. 8, 2000

[54] FOLDING CHAIR

[75] Inventor: Mario Bruschi, Bollate, Italy

[73] Assignee: Drake Corp., East Brunswick, N.J.

[21] Appl. No.: 09/337,257

[22] Filed: Jun. 22, 1999

[30] Foreign Application Priority Data

Apr. 16, 1999 [IT] Italy ..... MI990224 U

[51] Int. Cl.[7] ..... A47C 4/00

[52] U.S. Cl. ..... 297/59; 297/58; 297/239; 297/440.22

[58] Field of Search ..... 297/58, 55, 440.22, 297/239, 59

[56] References Cited

U.S. PATENT DOCUMENTS

| | | | |
|---|---|---|---|
| 1,674,220 | 6/1928 | Percival | 297/440.22 |
| 3,021,175 | 2/1962 | Norquist | 297/239 X |
| 3,042,447 | 7/1962 | Wilkinson | 297/58 |
| 4,298,227 | 11/1981 | Berthier et al. | 297/58 |
| 5,096,259 | 3/1992 | Stanfield | 297/58 X |
| 5,738,408 | 4/1998 | Wu | 297/239 |

FOREIGN PATENT DOCUMENTS

| | | | |
|---|---|---|---|
| 2445125 | 8/1980 | France | 297/58 |

*Primary Examiner*—Peter M. Cuomo
*Assistant Examiner*—Rodney B. White
*Attorney, Agent, or Firm*—Browdy and Neimark, P.L.L.C.

[57] ABSTRACT

An improved folding chair is provided, which comprises two uprights (2) each having an intermediate section (10), two struts (6) articulated on the uprights (2) and each having two ends (15*a*, 15*b*) defining a lower length than that of the uprights (2) and similar to that of the intermediate section (10), and a seat (9) articulated on the struts (6) and the uprights (2) and movable therewith between a use position, in which the uprights (2) and struts (6) are transverse to each other and define four supports resting on the ground, and a compacted position in which each strut (6) is disposed alongside an intermediate section (10) of an upright (2), each upright (2) being provided with shaped portions (14*a*, 14*b*) jutting out from opposite sides of the intermediate section (10) and forming stop abutments for the ends (15*a*, 15*b*) of a strut (6) of an adjacent folding chair.

17 Claims, 3 Drawing Sheets

FOLDING CHAIR

FIELD OF THE INVENTION

The invention relates to an improved folding chair, of the type comprising: two uprights, two struts of lower length than that of the uprights and articulated on the latter, and a seat articulated on the struts and uprights and movable therewith between a use position in which uprights and struts are transverse to each other to define, at the end portions thereof, four supports resting on the ground or legs, and a compacted position in which each strut is disposed alongside an intermediate section of an upright.

DESCRIPTION OF THE PRIOR ART

It is known that in folding chairs of the above mentioned type, uprights are generally parallel to and spaced apart from each other being joined by several crosspieces also forming a seat back.

Struts are generally parallel too and spaced apart from each other as well as joined by crosspieces.

In addition, struts are articulated on the uprights in a rotatable manner by means of pivot pins that at one side are fitted in a median region of the uprights and at the other side engage one end or a median region of the struts. These chairs when in their compacted position are flattened and can therefore be disposed tightly close to each other or stacked up so that altogether they have a minimum bulkiness.

The above is the best quality they have and by virtue of this quality they are widespread as emergency chairs or as chairs to be used at areas or premises that after each meeting must be completely cleared away.

This quality however can be partly impaired either by an inaccurate stacking up of these chairs, or by the fact that only small stacks of said chairs can be made in order to avoid them falling or being disarranged and stacked up in a disorderly manner.

In fact, when these chairs are stacked up they can easily slide on each other and due to the fact that—for practical reasons—only stacks or heaps of reduced sizes can be made, there are negative effects not only on the spaces required for temporary storage of these chairs, but also on the chair transportation modalities and times. Attempts have already been made to prevent these chairs from sliding on each other when they are in a stacked position by making appropriate male/female couplings on opposite faces of the chairs themselves.

It has been found however that these couplings, practically defined by button-shaped projections and corresponding niche-shaped recesses, imply modifications to the chairs at many points and that use of said couplings involves plenty of attention in the stacking operations.

A mistake or accidental shifting of a few millimetres between two chairs to be superposed on each other is in fact sufficient to make couplings non-operating and, on the contrary, to cause mutual slipping between these chairs more likely to occur.

The situation can be only slightly improved by widening the entrance section of the recesses. In fact the latter cannot be too wide, or otherwise they will weaken chairs too much. Neither recesses and projections can be too deep or jutting out too much, in order not to trigger breaking points in the chairs.

Furthermore, said projections placed along the chair uprights are often in contact with the body of the sitting person and can create disagreeable sensations and even tearings in clothes.

Other drawbacks of these chairs are either of a functional type again, because the same in use can oscillate or bear high loads with difficulty, or of an aesthetic type because in some cases folding chairs are not tuned to the features of the environments or uses for which they are intended.

It is to point out that all the above mentioned drawbacks cannot be easily remedied also due to the fact that chairs in question have the features of being greatly standardized as regards their structure and aesthetic aspect.

This standardization is to be maintained to ensure reduced costs and easy interchangeability.

It is therefore necessary to introduce all structural improvements or personalizations without modifying or radically changing the fundamental features of said chairs.

SUMMARY OF THE INVENTION

Under this situation, the general aim of the invention is to devise an improved folding chair, of the above type, capable of obviating the mentioned drawbacks, without however radically changing the traditional structure or aspect of said chair.

Within the scope of said general aim, it is an important aim of the invention to devise a folding chair capable of forming heaps or stacks that are very steady and easily transportable even if of wide sizes.

Another important aim of the invention is to devise a folding chair that can be easily personalized and easily adapted to the features of the environment for which it is intended.

A still further aim of the invention is to provide a folding chair which is particularly strong and of comfortable and sure use.

The aims specified are achieved by an improved folding chair which is characterized in that it comprises: two uprights each having an intermediate section, two struts articulated on said uprights and each having two ends defining a lower length than that of said uprights and similar to that of said intermediate section, and a seat articulated on said struts and uprights and movable therewith between a use position in which said uprights and struts are transverse to each other and define four supports resting on the ground, and a compacted position in which each strut is disposed alongside said intermediate section of one of said upright, and in that on opposite sides of said intermediate section each upright comprises shaped portions forming stop abutments for said ends of said struts of a superposed folding chair, in said compacted position.

BRIEF DESCRIPTION OF THE DRAWINGS

Description of a folding chair in accordance with the invention is now given hereinafter with reference to the accompanying drawings, in which.

DESCRIPTION OF THE PREFERRED EMBODIMENT

Figure 2:
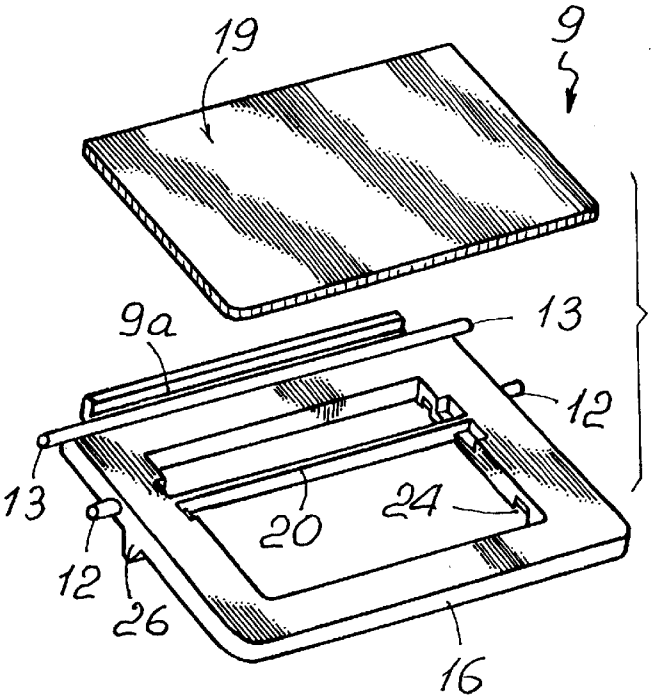
FIG. 2 is an exploded view of the chair seat structure.

With reference to the drawings, the folding chair is generally denoted by reference numeral 1.

It comprises, in a manner known per se, two uprights 2 parallelly spaced apart from each other and forming a first rigid frame 4 together with first crosspieces integrally connecting uprights 2 with each other and better described in the following.

Articulated on uprights 2, by means of first pivot pins 5, are two struts 6 of lower length than that of uprights 2. Struts 6 too are parallelly spaced apart from each other and integrally connected by second crosspieces, better described in the following, so as to form a second frame 8 of lower bulkiness than the first frame 4.

Figure 4:
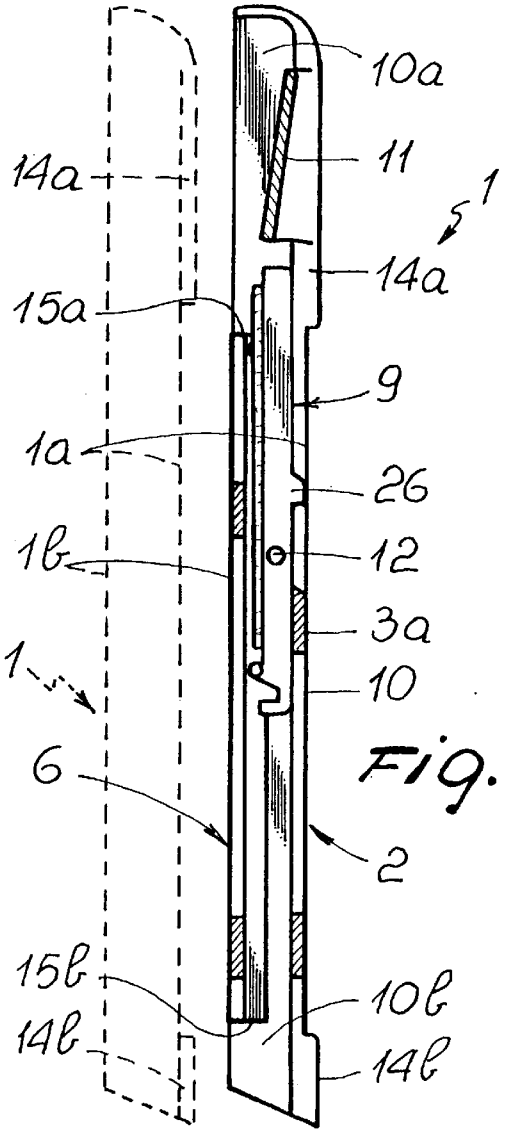
FIG. 4 shows the same chair section as in FIG. 1, in its compacted position and diagrammatically illustrated in side by side relationship with another chairs of like construction.

A seat 9 is then articulated on uprights 2 and struts 6 and is movable therewith between a use position (FIGS. 1 and 3) and a compacted position (FIG. 4).

In use position, uprights 2 and struts 6 are spread out and define four legs or supports on the ground (FIGS. 1, 3), whereas in the compacted position each strut 6 is placed alongside an intermediate section 10 of an upright 2.

In the embodiment shown the first pivot pins 5 are fitted, at one side, in a median region of uprights 2 and, at the other side, in one end of struts 6.

Said first crosspieces integral with uprights 2 form a chair back 11 at the upper part thereof, a first rest crosspiece 3*a* in the middle, and a first reinforcing crosspiece 3*b* at the lower part thereof.

The second crosspieces integral with struts 6 are defined by a second rest crosspiece 7*a* and a second reinforcing crosspiece 7*b* placed close to the upper and lower ends respectively of struts 6.

Seat 9 is associated by second pivot pins 12 with uprights 2, close to the first rest crosspiece 3*a*, and by third pivot pins 13 with struts 6, close to the second rest crosspiece 7*a*.

The second pivot pins 12 are only rotatable, whereas the third pivot pins 13 are slidable in substantially linear grooves 6*c* formed in struts 6.

Seat 9 then has a transverse housing 9*a* placed at the rear of the seat itself and adapted to hook the second rest crosspiece 7*a* from below.

Advantageously, the chair of the invention is substantially all made of plastic material and in particular uprights 2 and struts 6 are of plastic material.

Uprights 2 and struts 6 at cross sections transverse to their extension direction have right-angled profiles each having a larger wing 2*a* and 6*a* respectively and a smaller wing 2*b* and 6*b* respectively, each large wing being perpendicular to the respective small wing.

In the compacted position uprights and struts are close to each other so as to substantially define side columns having C-shaped profiles.

In the compacted position side columns the large side wings 2*a* of uprights 2 are tightly close to the small wings 6*b* of struts 6.

As shown in FIG. 4, in the compacted position the folding chair 1 forms a flattened body having substantially parallel first and second major faces 1*a*, 1*b* defining the stacking faces of chair 1.

The first major face 1*a* is practically delimited and defined by the small front wings 2*b* of uprights 2, whereas the second major face 1*b* opposite to the first one is substantially defined by the large front wings 6*a* of struts 6.

The large front wings 2*a* of uprights 2 extend between two major faces 1*a*, 1*b* so that they mostly define the thickness of chair 1 once it has been folded.

As already pointed out, uprights 2 have, lengthwise, an intermediate section 10 which is distinguishable because it has a strut 6 alongside it when the chair is folded.

The intermediate section 10 is located between first and second end sections 10*a* and 10*b* defining a section of uprights 2 connected with the chair back 11 and a section of uprights 2 resting on the ground, respectively.

Figure 1:
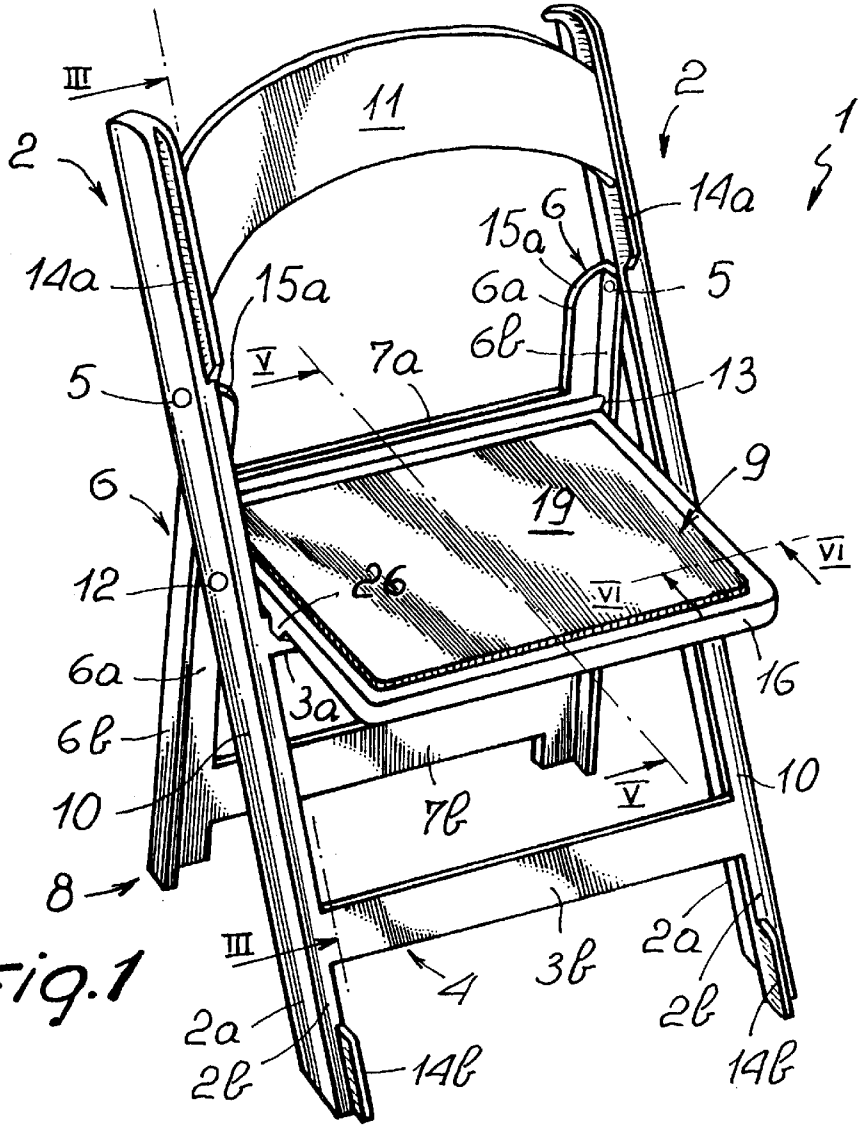
FIG. 1 generally shows a chair in accordance with the invention in a perspective view, in its use position.
Figure 3:
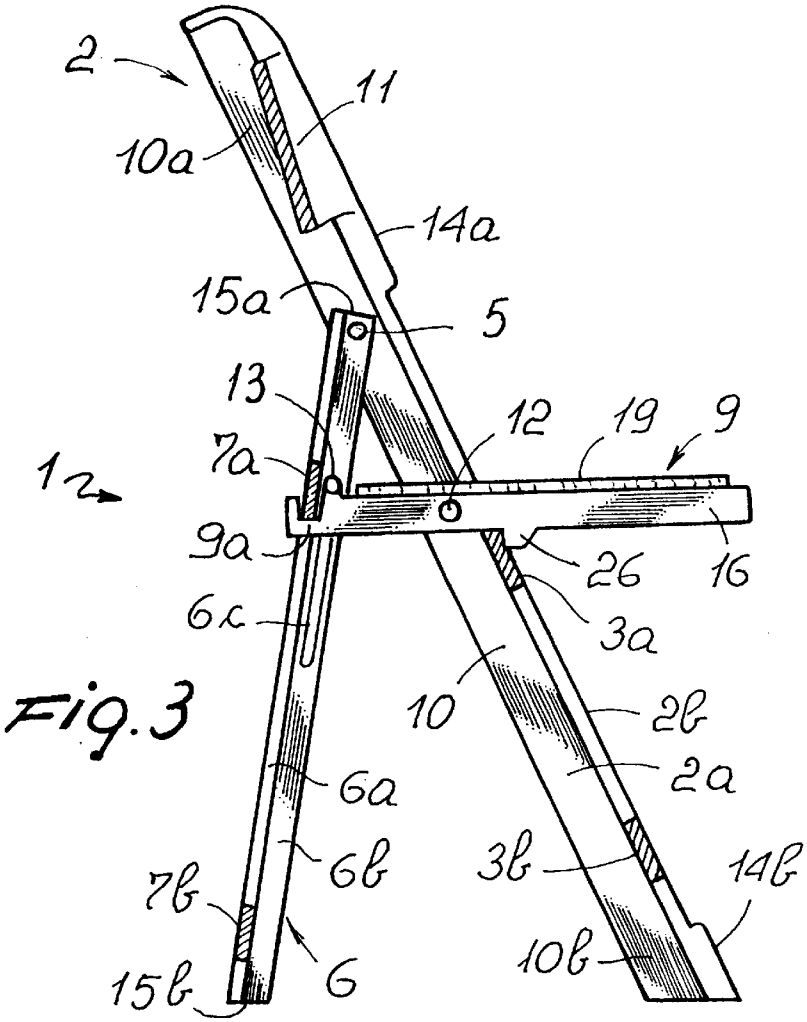
FIG. 3 shows a section of the chair in FIG. 1, in its use position, taken along line III—III.

As shown in FIGS. 1, 3 and 4, each upright 2, at its end sections 10*a*, 10*b* on opposite sides to the intermediate section 10, has first and second shaped portions 14*a*, 14*b* such structured that they form stop abutments for first and second ends 15*a* and 15*b* of a strut 6 of a superposed an adjacent chair in the compacted position.

In each upright 2 the following parts can be distinguished: a first shaped portion 14*a* on the first end section 10*a*, adapted to create an abutment for the first end 15*a* of a strut 6 and a second shaped portion 14*b* on the second end section 10*b*, adapted to create an abutment for the second end 15*b* of the same strut.

Shown in the drawings are shaped portions 14*a*, 14*b* extending in a direction transverse to the first major face 1*a*, substantially over the whole length of the end sections 10*a*, 10*b* of each upright 2.

In addition, the first shaped portion 14*a* is structured like an expansion or widening of the chair back 11 for achieving a wider and more efficient side support for shoulders, so as to partly recall anatomic seats for cars, for example.

The second shaped portion 14*b* then is structured like an expansion or widening of the supports on the ground, so that it reminds the shape of a rest foot capable of making the chair steadier.

As a last detail it is pointed out that the shaped portions 14*a*, 14*b* are integral with and transverse to the small front wings 2*b* of uprights 2 and project from a free edge of same in a direction parallel to and spaced apart from, the large side wings 2*a*.

Figure 5:
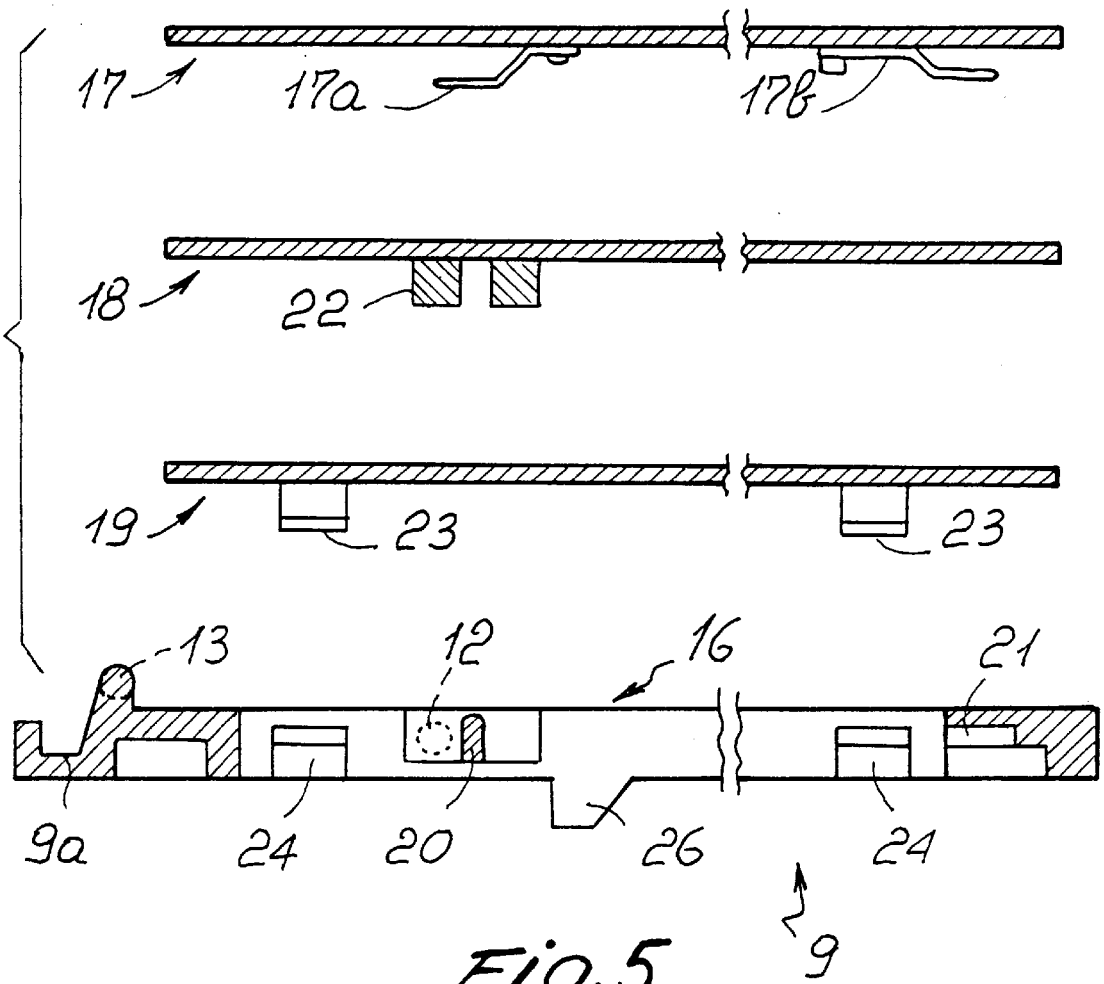
FIG. 5 is an exploded view showing in section, along line V—V in FIG. 1, several different conformations of the chair seat.

FIGS. 2, 5 and 6 show the structure of seat 9 in detail.

It is highlighted that seat 9 comprises a base element 16, which is in movable engagement with uprights 2 and struts 6, and a covering element removably connected with the base element 16.

In addition, the base element 16 is substantially a bearing frame or band having a plurality of attachments for the covering element.

In an original manner, these attachments are capable of enabling hooking of any covering element. In fact, as shown in FIGS. 2 and 5, several different types of covering elements can be applied, such as a first type, a second type and a third type denoted by 17, 18 and 19 respectively.

For engagement of the first covering type 17, provided with anchoring elements 17*a* and a hook 17*b*, the attachments on the bearing frame 16 comprise a small bar 20 and a thinned portion 21.

The small bar 20 can be also used for engagement with the second type of covering 18, provided with a grooved crosspiece 22 to be fitted on the small bar 20.

For engagement with the third type of covering 19, provided with coupling teeth 23, the bearing frame 16 comprises multiple attachments for snap fitting 4.

Figure 6A:
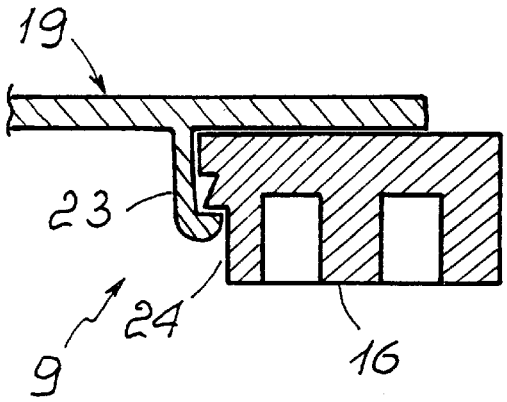
FIG. 6*a* shows a seat section taken along line VI—VI in FIG. 1, in the case of a seat provided with couplings.
Figure 6B:
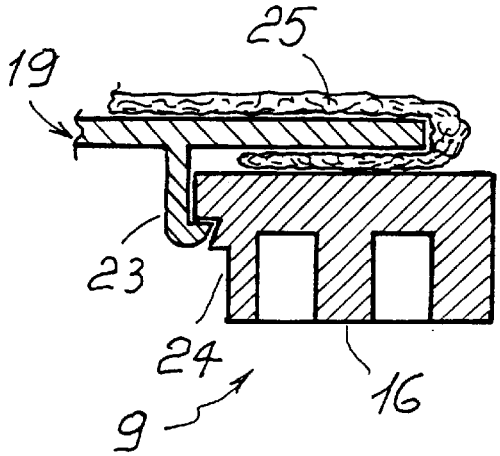
FIG. 6*b* is similar to the preceding one and shows the same seat covered with an additional lining.

FIGS. 6*a*, 6*b* show attachments 24 in section and highlight how the same enable a differentiated approaching of covering 19 to be achieved. Due to this fact said covering can be also arranged with a lining 25.

Preferably, the covering element used is the one denoted by 19, defined by a plate of plastic material preferably provided with an anatomic profile.

This plate of plastic material has the advantage of being a very cheap element that can be easily decorated on its surface.

A further important feature of seat 9 is that of being provided with pawls 26 projecting from base 16 at the lower part thereof and adapted for engagement with the rest crosspiece 3*a* so as to lock any possible sliding of seat 9 on the rest crosspiece 3*a* itself.

In other words, as shown in FIG. 3, pawls 26 lock struts 6 in such a manner that they prevent the compass-like opening of struts 6 from widening relative to uprights 2 when a downward pressure is exerted on seat 9.

Without these pawls 26, all efforts for locking further spreading apart of struts 6 relative to uprights 2, due to the supported weight, would be exerted by the second pivot pins 12.

Use of chair 1 is as follows.

When the chair is in a compacted position, it can be easily and steadily stacked up or heaped up with other chairs.

In the heaped position the shaped portions 14*a*, 14*b* of uprights 2 are disposed after, i.e. in the extension of, ends 15*a*, 15*b* of struts 6, so preventing any possibility of lengthwise sliding of the stacked chairs 1.

As is clear from FIGS. 1, 3 and 4, the shaped portions 14*a* and 14*b* are arranged on the front wings 2*b* of the uprights 2 opposite the side wings 2*a* and laterally offset relative to the side wings 2*a* and act as rest abutments for the side wings 2*a* of a superposed chair 1, so preventing sideways sliding of the stacked chairs 1.

Locking is efficient even if some play exists between the shaped portions 14*a*, 14*b* and ends 15*a*, 15*b* and, even better, this play may be wide to promote stacking up.

Practically a correct and steady stacking up of chairs is obtained even when the superposition operation is carried out very quickly.

Struts 6 are not at all modified in that no groove or recess is formed therein, and therefore, on the one hand, modifications to the chair are minimum and, on the other hand, the shaped portions 14*a*, 14*b* can be even very wide and jut out without creating corresponding weakening points in struts 6.

It is pointed out at all events that the shaped portions 14*a*, 14*b* do not cause trouble to users, in that they are placed at the ends of uprights 2.

On the contrary, in the particular embodiment shown the shaped portions 14*a*, 14*b* increase the functional character and use comfort of chair 1, by widening and conveniently shaping the chair back 11 and the supports on the ground.

In its use position, chair 1 is then very steady and safe due to how seat 9 is anchored to uprights 2, struts 6 and the first and second rest crosspieces 3*a* and 7*a*.

An important function is performed in this connection by pawls 26 that "discharge" stresses that would be otherwise present on the second pivot pins 12 and prevent opening between struts 6 and uprights 2 from spreading apart too much.

As already pointed out, without these pawls 26 arranged on seat 9, all efforts for locking spreading apart of struts 6 relative to uprights 2, due to the supported weight, would be exercised by the second pivot pins 12.

It is suitable for these pivot pins not to be subjected to great efforts not only in order to avoid breaking risks but also for preventing them from getting deformed.

In fact the second pivot pins 12 constitute the fulcrum or rotation centre of seat 9 and every deformation of same involves difficult, irregular and unpleasant operations for opening and closing chair 1.

It is finally to note that the seat 9 of the chair in accordance with the invention further has the advantage of being of a universal type and being susceptible of easy personalization.

Its being of a universal type is due to the fact that it comprises a base element 16 consisting of a bearing frame or band having a plurality of attachments adapted to most of the covering elements 17, 18, 19 presently available on the market.

In addition, multiple attachments for snap-fitting 23 are provided so as to enable a differentiated approaching of covering 19, which will bring about the possibility of arranging a lining 25 thereon.

The seat can be easily personalized due both to the possibility of choosing and changing the seat covering at will, and to the arrangement of a covering element 19 defined by a plate of plastic material that can be easily decorated on its surface. Decorations can be freely applied either by traditional printing techniques or by flexographic print so as to decorate curved regions as well, or by directly burying labels and films into the mould forming the covering element 19.

Therefore, personalization of the chair, by means of coats of arms and/or marks and/or advertising and/or indications of various type can be stressed to a maximum extent while being done with the lowest costs, and can also be obtained with linings 25 of varying colours and/or patterns. At all events, personalizations do not greatly affect costs as they only concern a plate-like element and are easily removable and replaceable.

What is claimed is:

1. A folding chair of the type allowing stacking of a plurality of chairs of the same construction, comprising;

two uprights, each having two ends sections and an intermediate section therebetween having a length;

two struts each articulated on a respective one of said uprights and each having two ends and a length substantially corresponding to the length of said intermediate section of said uprights;

a seat articulated on said struts and uprights and movable therewith between a use position in which said uprights and said struts are spread out and define four supports of said chair resting on the ground, and a compacted position in which each of said struts is disposed alongside said intermediate section of a respective one of said uprights;

wherein said uprights comprise, at said end sections, shaped portions forming stop abutments for ends of struts of another chair of the plurality of chairs in compacted positions, thereby preventing lengthwise sliding of stacked chairs;

said uprights and said struts having cross-sections defining right-angled profiles and being formed by front wings and side wings perpendicular to each other, said side wings of said struts being close to said side wings of said uprights in said compacted positions; and said shaped portions of said uprights being arranged on said front wings opposite said side wings and laterally offset relative to said side wings of said uprights and forming rest abutments for the side wings of the uprights of another chair in compacted position, thereby preventing sideways sliding of stacked chairs.

2. A folding chair as claimed in claim 1, wherein said shaped portions substantially extend over the whole length of said end sections.

3. A folding chair as claimed in claim 1, wherein each of said uprights has, on opposite sides of said intermediate section, a first end section integral with a chair back and a second end section defining supports resting on the ground, and wherein said shaped portions are expansions of said back and said supports.

4. A folding chair as claimed in claim 1, wherein said seat comprises a base element connected to said uprights and said struts, and a covering element removably connected to said base element, and wherein said base element is a bearing frame having a variety of attachments for a plurality of covering elements.

5. A folding chair as claimed in claim 4, wherein said bearing frame comprises multiple snap-fitting attachments for said covering element, and wherein said multiple snap-fitting attachments are differentiated from each other according to their distance from said covering element, to enable employment of lined covering elements.

6. A folding chair as claimed in claim 4, wherein said covering element is a plate of plastic material decorated on its surface.

7. A folding chair as claimed in claim 1, wherein said uprights are connected with each other by crosspieces comprising a rest crosspiece for said seat in said use position, and wherein said seat comprises pawls susceptible of engagement with said rest crosspiece and adapted to lock said seat to said rest crosspiece preventing said seat from sliding.

8. A folding chair as claimed in claim 1, wherein said wings comprise a large wing and a small wing perpendicular to each other.

9. A folding chair as claimed in claim 8, wherein in said compacted position said large wings of said uprights are close to said small wings of said struts.

10. A folding chair as claimed in claim 8, wherein said small wings of said uprights define said fronts wings, and wherein each of said small wings of said uprights has a free edge spaced apart from the respective one of said large wings, each of said shaped portions emerging from said free edge.

11. A folding chair as claimed in claim 8, wherein in said compacted position said large wings of said uprights substantially define the thickness of said chair, and wherein said shaped portions jut out in a direction parallel to said large wings.

12. A folding chair, comprising: two uprights, each having two end sections and an intermediate section therebetween having a length, two struts each articulated on a respective one of said uprights and each having two ends and a length substantially corresponding to the length of said intermediate section of said uprights, and a seat articulated on said struts and uprights and movable therewith between a use position in which said uprights are spread out and define four supports resting on the ground, and a compacted position in which each of said struts is disposed alongside said intermediate section of a respective one of said uprights, said seat comprising a base element connected with said uprights and said struts and a covering element removably connected with said base element, and wherein said base element is a bearing frame having a variety of attachments for a plurality of covering elements.

13. A folding chair as claimed in claim 12, wherein said bearing frame comprises multiple snap-fitting attachments for said covering element, and wherein said multiple snap-fitting attachments are differentiated from each other according to their distance from said covering element, to enable employment of lined covering elements.

14. A folding chair as claimed in claim 12, wherein said covering element is a plate of plastic material decorated on its surface.

15. A folding chair, comprising: two uprights, each having two end sections and an intermediate section therebetween having a length, two struts each articulated on a respective one of said uprights and each having two ends and a length substantially corresponding to the length of said intermediate section of said uprights, and a seat articulated on said struts and uprights and movable therewith between a use position in which said uprights and struts are spread out and define four supports resting on the ground, and a compacted position in which each of said struts is disposed alongside said intermediate section of a respective one of said uprights, said uprights being connected with each other by crosspieces comprising a rest crosspiece for said seat in said use position, and wherein said seat comprises pawls susceptible of engagement with said rest crosspiece and adapted to lock said seat to said rest crosspiece preventing said seat from sliding.

16. A folding chair as claimed in claim 1, wherein said struts and said uprights are made of plastic materials.

17. A folding chair as claimed in claim 1, wherein said shaped portions are integral with said front wings of said uprights.

* * * * *